US008890399B2

(12) United States Patent
Ma

(10) Patent No.: US 8,890,399 B2
(45) Date of Patent: Nov. 18, 2014

(54) METHOD OF MAKING RUTHENIUM-BASED MATERIAL FOR SPARK PLUG ELECTRODE

(71) Applicant: Federal-Mogul Ignition Company, Southfield, MI (US)

(72) Inventor: Shuwei Ma, Ann Arbor, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 45 days.

(21) Appl. No.: 13/898,016

(22) Filed: May 20, 2013

(65) Prior Publication Data

US 2013/0313961 A1 Nov. 28, 2013

Related U.S. Application Data

(60) Provisional application No. 61/650,233, filed on May 22, 2012.

(51) Int. Cl.
*H01T 13/20* (2006.01)
*H01T 13/39* (2006.01)
*H01T 21/02* (2006.01)

(52) U.S. Cl.
CPC ..... *H01T 13/39* (2013.01); *H01T 21/02* (2013.01)
USPC ..... 313/143; 313/141

(58) Field of Classification Search
USPC ..... 313/141–143
See application file for complete search history.

(56) References Cited

U.S. PATENT DOCUMENTS

| | | | |
|---|---|---|---|
| 2,328,580 | A | 9/1943 | Pickus |
| 2,391,456 | A | 12/1945 | Hensel |
| 2,391,457 | A | 12/1945 | Carlson |
| 2,406,172 | A | 8/1946 | Smithells |
| 2,470,034 | A | 5/1949 | Hensel |
| 2,545,438 | A | 3/1951 | Stumbpck |
| 3,159,460 | A | 12/1964 | Hill |
| 3,278,280 | A | 10/1966 | Holtz |
| 3,362,799 | A | 1/1968 | Jones et al. |
| 3,466,158 | A | 9/1969 | Rhys |
| 3,528,862 | A | 9/1970 | Jones et al. |
| 3,868,430 | A | 2/1975 | Giangaspero |
| 3,957,451 | A | 5/1976 | Rasmussen et al. |
| 3,977,841 | A | 8/1976 | Rasmussen et al. |

(Continued)

FOREIGN PATENT DOCUMENTS

| | | |
|---|---|---|
| DE | 10005559 | 8/2001 |
| GB | 556253 | 9/1943 |

(Continued)

OTHER PUBLICATIONS

Written Opinion & International Search Report for PCT/US13/041803, Aug. 23, 2013, 9 pages.

*Primary Examiner* — Mary Ellen Bowman
(74) *Attorney, Agent, or Firm* — Reising Ethington P.C.

(57) ABSTRACT

A method of making an electrode material for use in a spark plug and other ignition devices including industrial plugs, aviation igniters, glow plugs, or any other device that is used to ignite an air/fuel mixture in an engine. The electrode material is a ruthenium-based material that includes a "fibrous" grain structure. The disclosed method includes hot-forming a ruthenium-based material into an elongated wire that includes the "fibrous" grain structure while intermittently annealing the ruthenium-based material as needed. The intermittent annealing is performed at a temperature that maintains the "fibrous" grain structure.

20 Claims, 3 Drawing Sheets

(56) References Cited

U.S. PATENT DOCUMENTS

| | | | |
|---|---|---|---|
| 4,324,588 | A | 4/1982 | Zysk et al. |
| 4,351,095 | A | 9/1982 | Davies |
| 4,427,915 | A | 1/1984 | Nishio et al. |
| 4,659,960 | A | 4/1987 | Toya |
| 4,692,657 | A | 9/1987 | Grunwald et al. |
| 4,743,793 | A | 5/1988 | Toya et al. |
| 4,771,209 | A | 9/1988 | Ryan |
| 4,786,267 | A | 11/1988 | Toya et al. |
| 4,881,913 | A | 11/1989 | Mann |
| 4,910,428 | A | 3/1990 | Strumbos |
| 4,939,409 | A | 7/1990 | Friese et al. |
| 5,101,135 | A | 3/1992 | Oshima |
| 5,347,193 | A | 9/1994 | Oshima |
| 5,448,130 | A | 9/1995 | Matsutani et al. |
| 5,456,624 | A | 10/1995 | Moore |
| 5,461,275 | A | 10/1995 | Oshima |
| 5,514,929 | A | 5/1996 | Kawamura |
| 5,550,425 | A | 8/1996 | Yoder |
| 5,578,895 | A | 11/1996 | Oshima |
| 5,675,209 | A | 10/1997 | Hall, Jr. |
| 5,793,793 | A | 8/1998 | Matsutani et al. |
| 5,796,019 | A | 8/1998 | Lupton |
| 5,866,973 | A | 2/1999 | Kagawa et al. |
| 5,869,921 | A | 2/1999 | Matsutani |
| 5,890,272 | A | 4/1999 | Liberman |
| 5,894,186 | A | 4/1999 | Matsutani et al. |
| 5,898,257 | A | 4/1999 | Sequerra et al. |
| 5,977,695 | A | 11/1999 | Osamura et al. |
| 5,990,602 | A | 11/1999 | Katoh et al. |
| 5,997,695 | A | 12/1999 | Limarinen |
| 5,998,913 | A | 12/1999 | Matsutani et al. |
| 6,045,424 | A | 4/2000 | Chang et al. |
| 6,046,532 | A | 4/2000 | Matsutani et al. |
| 6,071,163 | A | 6/2000 | Chang et al. |
| 6,094,000 | A | 7/2000 | Osamura et al. |
| 6,095,124 | A | 8/2000 | Matsubara et al. |
| 6,121,719 | A | 9/2000 | Matsutani et al. |
| 6,166,479 | A | 12/2000 | Matasutani et al. |
| 6,262,522 | B1 | 7/2001 | Osamura et al. |
| 6,304,022 | B1 | 10/2001 | Matsutani et al. |
| 6,326,719 | B1 | 12/2001 | Boehler |
| 6,407,487 | B1 | 6/2002 | Sugimoto |
| 6,412,465 | B1 | 7/2002 | Lykowski |
| 6,523,515 | B2 | 2/2003 | Kano |
| 6,533,628 | B1 | 3/2003 | Matsutani |
| 6,579,738 | B2 | 6/2003 | Farrar |
| 6,611,083 | B2 | 8/2003 | LaBarge et al. |
| 6,628,051 | B1 | 9/2003 | Menken |
| 6,664,719 | B2 | 12/2003 | Matsutani et al. |
| 6,750,597 | B1 | 6/2004 | Sakura |
| 6,790,113 | B1 | 9/2004 | Fujita |
| 6,794,803 | B2 | 9/2004 | Hori et al. |
| 6,798,125 | B2 | 9/2004 | Sugiyama et al. |
| 6,864,622 | B2 | 3/2005 | Matsutani et al. |
| 6,869,328 | B2 | 3/2005 | Ulm et al. |
| 7,084,558 | B2 | 8/2006 | Teramura et al. |
| 7,131,191 | B2 | 11/2006 | Matsutani et al. |
| 7,132,782 | B2 | 11/2006 | Kato et al. |
| 7,150,252 | B2 | 12/2006 | Sugiyama et al. |
| 7,164,225 | B2 | 1/2007 | Yoshimoto et al. |
| 7,221,078 | B2 | 5/2007 | Watanabe |
| 7,279,827 | B2 | 10/2007 | Nunome et al. |
| 7,288,879 | B2 | 10/2007 | Matsutani et al. |
| 7,321,187 | B2 | 1/2008 | Teramura et al. |
| 7,336,024 | B2 | 2/2008 | Yoshimoto et al. |
| 7,382,084 | B2 | 6/2008 | Yoshimoto et al. |
| 7,385,339 | B2 | 6/2008 | Lineton et al. |
| 7,449,823 | B2 | 11/2008 | Menken et al. |
| 7,550,906 | B2 | 6/2009 | Yoshimoto et al. |
| 7,569,979 | B2 | 8/2009 | Lykowski et al. |
| 7,637,793 | B2 | 12/2009 | Lintunen et al. |
| 7,815,849 | B2 | 10/2010 | Koch et al. |
| 2002/0024160 | A1 | 2/2002 | Sugimoto |
| 2003/0178925 | A1 | 9/2003 | Kumagai |
| 2004/0140745 | A1 | 7/2004 | Hrastnik |
| 2004/0266306 | A1 | 12/2004 | Matsutani et al. |
| 2005/0168121 | A1 | 8/2005 | Tinwell |
| 2005/0179353 | A1 | 8/2005 | Watanabe |
| 2006/0158082 | A1 | 7/2006 | Menken |
| 2007/0057613 | A1 | 3/2007 | Brady |
| 2007/0190364 | A1 | 8/2007 | Das |
| 2007/0236123 | A1 | 10/2007 | Lykowski |
| 2007/0236124 | A1 | 10/2007 | Lykowski |
| 2008/0074025 | A1 | 3/2008 | Hori |
| 2008/0206601 | A1 | 8/2008 | Mukai |
| 2008/0308057 | A1 | 12/2008 | Lykowski |
| 2009/0284117 | A1 | 11/2009 | Lykowski |
| 2010/0026159 | A1 | 2/2010 | Ohm |
| 2010/0052497 | A1 | 3/2010 | Walker, Jr. |
| 2010/0109502 | A1 | 5/2010 | Nakayama |
| 2010/0117506 | A1 | 5/2010 | Suzuki et al. |
| 2010/0253203 | A1 | 10/2010 | Suzuki et al. |
| 2010/0264801 | A1 | 10/2010 | Tanaka |
| 2010/0264802 | A1 | 10/2010 | Tanaka |
| 2010/0275869 | A1 | 11/2010 | Musasa et al. |
| 2011/0043093 | A1 | 2/2011 | Nunome |
| 2011/0127900 | A1* | 6/2011 | Ma et al. ..... 313/141 |
| 2011/0198983 | A1 | 8/2011 | Manhardt |
| 2012/0025690 | A1 | 2/2012 | Kohl |
| 2012/0025692 | A1 | 2/2012 | Ma |

FOREIGN PATENT DOCUMENTS

| | | |
|---|---|---|
| GB | 575998 | 3/1946 |
| GB | 717496 | 10/1954 |
| GB | 755835 | 8/1956 |
| GB | 830628 | 3/1960 |
| JP | 2207476 | 8/1990 |
| JP | 7268574 | 10/1995 |
| JP | 8339880 | 12/1996 |
| JP | 2000331770 | 11/2000 |
| JP | 2001262253 | 9/2001 |
| JP | 2002346625 | 12/2002 |
| JP | 2003053419 | 2/2003 |
| JP | 2004031300 | 1/2004 |
| JP | 3902756 | 5/2004 |
| JP | 2004235040 | 8/2004 |
| JP | 2008053017 | 3/2008 |
| JP | 2008053018 | 3/2008 |
| KR | 20020050486 | 6/2002 |

* cited by examiner

METHOD OF MAKING RUTHENIUM-BASED MATERIAL FOR SPARK PLUG ELECTRODE

REFERENCE TO RELATED APPLICATIONS

This application claims the benefit of U.S. Provisional Ser. No. 61/650,233 filed on May 22, 2012, the entire contents of which are incorporated herein.

TECHNICAL FIELD

This invention generally relates to spark plugs and other ignition devices for internal combustion engines and, in particular, to electrode materials for spark plugs and methods of making them.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

A method of making an electrode material is disclosed. In one embodiment, the method comprises forming a ruthenium-based material into a bar that has a length and a first diameter. The bar is then hot-formed into an elongated wire that has a second diameter, which is smaller than the first diameter, and a fibrous grain structure. During hot-forming of the bar into the elongated wire, the ruthenium-based material is intermittently annealed to maintain its fibrous grain structure as the ruthenium-based material undergoes diameter reduction from the first diameter of the bar to the second diameter of the elongated wire.

In another embodiment, the method comprises hot-drawing a ruthenium-based material through an opening defined in a heated draw plate along an elongation axis to provide the ruthenium-based material with elongated grains generally parallel to the elongation axis. The method also calls for annealing the ruthenium-based material at a temperature that maintains the elongated grains when needed. The hot-drawing and annealing steps are repeated to form an elongated wire of the ruthenium-based material.

Also disclosed is a spark plug that comprises a center electrode and a ground electrode according to any of a number of suitable configurations. The center electrode, the ground electrode, or both the center electrode and the ground electrode may include an electrode material. The electrode material, more specifically, may be a ruthenium-based material that has a fibrous grain structure.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
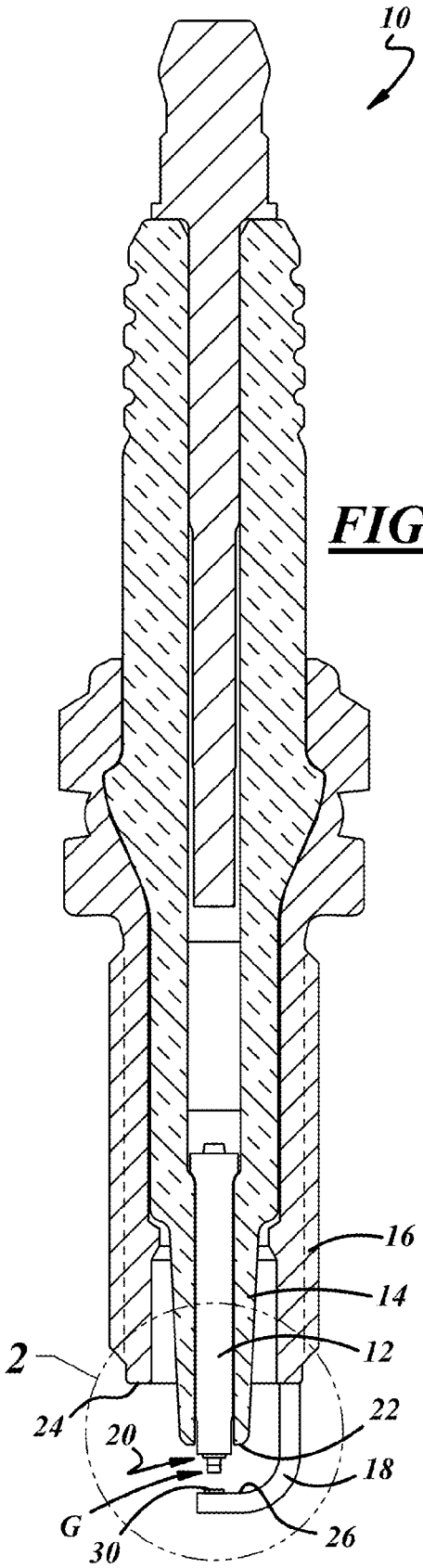
FIG. 1 is a cross-sectional view of an exemplary spark plug that may use the electrode material described below.

The electrode material described herein may be used in spark plugs and other ignition devices including industrial plugs, aviation igniters, glow plugs, or any other device that is used to ignite an air/fuel mixture in an engine. This includes, but is certainly not limited to, the exemplary spark plugs that are shown in the drawings and are described below. Furthermore, it should be appreciated that the electrode material may be used in a firing tip that is attached to a center and/or ground electrode or it may be used in the actual center and/or ground electrode itself, to cite several possibilities. Other embodiments and applications of the electrode material are also possible. All percentages provided herein are in terms of weight percentage (wt %).

Figure 2:
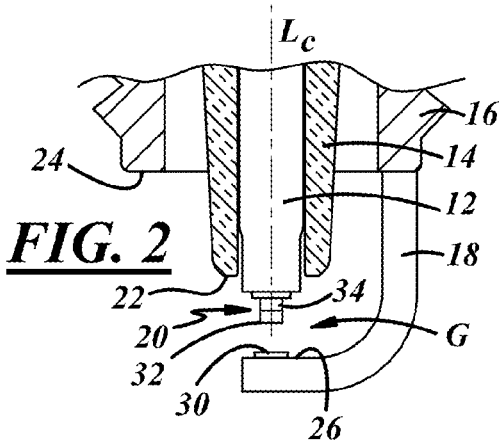
FIG. 2 is an enlarged view of the firing end of the exemplary spark plug from FIG. 1, wherein a center electrode has a firing tip in the form of a multi-piece rivet and a ground electrode has a firing tip in the form of a flat pad.

Referring to FIGS. 1 and 2, there is shown an exemplary spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a multi-piece rivet that includes a first component 32 made from an erosion- and/or corrosion-resistant electrode material, and a second component 34 made from an intermediary material like a high-chromium nickel alloy. In this particular embodiment, the first component 32 has a cylindrical shape and the second component 34 has a stepped shape that includes a diametrically-enlarged head section and a diametrically-reduced stem section. The first and second components 32, 34 may be attached to one another via a laser weld, a resistance weld, or some other suitable welded or non-welded joint. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes a side surface 26 that opposes the firing tip 20 of the center electrode 12 and has a firing tip 30 attached thereto. The firing tip 30 is in the form of a flat pad and defines a spark gap G with the center electrode firing tip 20 such that they provide sparking surfaces for the emission and reception of electrons across the spark gap.

Figure 3:
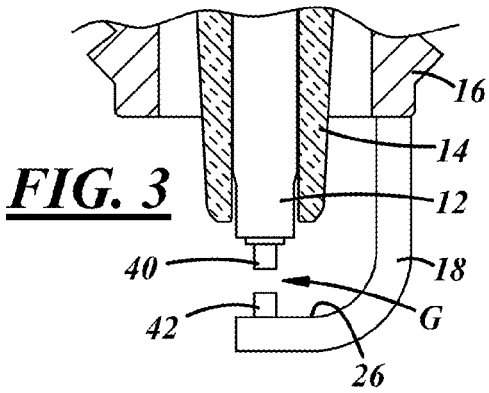
FIG. 3 is an enlarged view of a firing end of another exemplary spark plug that may use the electrode material described below, wherein the center electrode has a firing tip in the form of a single-piece rivet and the ground electrode has a firing tip in the form of a cylindrical tip.
Figure 4:
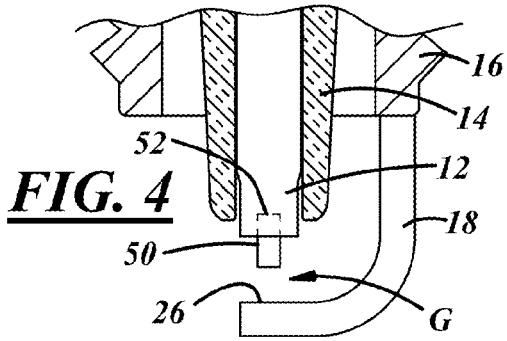
FIG. 4 is an enlarged view of a firing end of another exemplary spark plug that may use the electrode material described below, wherein the center electrode has a firing tip in the form of a cylindrical tip located in a recess and the ground electrode has no firing tip.
Figure 5:
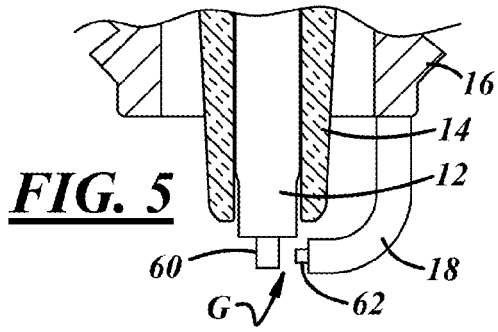
FIG. 5 is an enlarged view of a firing end of another exemplary spark plug that may use the electrode material described below, wherein the center electrode has a firing tip in the form of a cylindrical tip and the ground electrode has a firing tip in the form of a cylindrical tip that extends from an axial end of the ground electrode.

In this particular embodiment, the first component 32 of the center electrode firing tip 20 and/or the ground electrode firing tip 30 may be made from the electrode material described herein; however, these are not the only applications for the electrode material. For instance, as shown in FIG. 3, the exemplary center electrode firing tip 40 and/or the ground electrode firing tip 42 may also be made from the electrode material. In this case, the center electrode firing tip 40 is a single-piece rivet and the ground electrode firing tip 42 is a cylindrical tip that extends away from a side surface 26 of the ground electrode by a considerable distance. The electrode material may also be used to form the exemplary center electrode firing tip 50 and/or the ground electrode 18 that is shown in FIG. 4. In this example, the center electrode firing tip 50 is a cylindrical component that is located in a recess or blind hole 52, which is formed in the axial end of the center electrode 12. The spark gap G is formed between a sparking surface of the center electrode firing tip 50 and a side surface 26 of the ground electrode 18, which also acts as a sparking surface. FIG. 5 shows yet another possible application for the electrode material, where a cylindrical firing tip 60 is attached to an axial end of the center electrode 12 and a cylindrical firing tip 62 is attached to an axial end of the ground electrode 18. The ground electrode firing tip 62 forms a spark gap G with a side surface of the center electrode firing tip 60, each of which may be made from the electrode material, and is thus a somewhat different firing end configuration than the other exemplary spark plugs shown in the drawings.

Again, it should be appreciated that the non-limiting spark plug embodiments described above are only examples of some of the potential uses for the electrode material, as it may be used or employed in any firing tip, electrode, spark surface or other firing end component that is used in the ignition of an air/fuel mixture in an engine. For instance, the following components may be formed from the electrode material: center and/or ground electrodes; center and/or ground electrode firing tips that are in the shape of rivets, cylinders, bars, columns, wires, balls, mounds, cones, flat pads, disks, rings, sleeves, etc.; center and/or ground electrode firing tips that are attached directly to an electrode or indirectly to an electrode via one or more intermediate, intervening or stress-releasing layers; center and/or ground electrode firing tips that are located within a recess of an electrode, embedded into a surface of an electrode, or located on an outside of an electrode such as a sleeve or other annular component; or spark plugs having multiple ground electrodes, multiple spark gaps or semi-creeping type spark gaps. These are but a few examples of the possible applications of the electrode material. As used herein, the term "electrode" —whether pertaining to a center electrode, a ground electrode, a spark plug electrode, etc.—may include a base electrode member by itself, a firing tip by itself, or a combination of a base electrode member and one or more firing tips attached thereto, to cite several possibilities.

The electrode material is a ruthenium-based material that has a "fibrous" grain structure (sometimes referred to as an "elongated grain structure"). The term "ruthenium-based material," as used herein, broadly includes any material where ruthenium (Ru) is the single largest constituent on a weight percentage (%) basis. This may include materials having greater than 50% ruthenium, as well as those having less than 50% ruthenium so long as the ruthenium is the single largest constituent. One or more precious metals other than ruthenium may also be included in the ruthenium-based material. Some examples of suitable precious metals are rhodium (Rh), platinum (Pt), iridium (Ir), palladium (Pd) and combinations thereof. It is also possible for the ruthenium-based material to include one or more rare earth metals or active elements like yttrium (Y), hafnium (Hf), scandium (Sc), zirconium (Zr), lanthanum (La), cerium (Ce), and/or other constituents. Skilled artisans will appreciate that ruthenium has a rather high melting temperature (2334° C.) compared to some precious metals, which can be indicative of better relative erosion resistance. But ruthenium can be more susceptible to oxidation and corrosion than some precious metals. Thus, in addition to having the "fibrous" grain structure described below, the ruthenium-based material may include at least one of rhenium (Re) and tungsten (W). The following embodiments are examples of different ruthenium-based materials that may be used, but they are not meant to be an exhaustive list of all such embodiments, as others are certainly possible. It should be appreciated that any number of other constituents may be added to the following embodiments. A periodic table published by the International Union of Pure and Applied Chemistry (IUPAC) is provided in Addendum A (hereafter the "attached periodic table") and is to be used with the present application.

The ruthenium-based material may include a precious metal in addition to ruthenium such as, for example, at least one of rhodium, iridium, platinum, palladium, gold, or a combination thereof. Any of the following alloy systems may be appropriate: Ru—Rh, Ru—Ir, Ru—Pt, Ru—Pd, Ru—Au, Ru—Rh—Ir, Ru—Rh—Pt, Ru—Rh—Pd, Ru—Rh—Au, Ru—Ir—Pt, Ru—Ir—Pd, and Ru—Ir—Au. Some specific non-limiting examples of potential compositions for the ruthenium-based material include (the following compositions are given in weight percentage, and the Ru constitutes the balance): Ru-(1-45)Rh; Ru-(1-45)Ir; Ru-(1-45)Pt; Ru-(1-45)Pd; Ru-(1-45)Au; Ru-(1-30)Rh; Ru(1-20)Rh; Ru-(1-15)Rh; Ru-(1-10)Rh; Ru(1-8)Rh; Ru-(1-5)Rh; Ru-(1-2)Rh; Ru-45Rh; Ru-40Rh; Ru-30Rh; Ru-25Rh; Ru-20Rh; Ru-15Rh; Ru-10Rh; Rh-8Rh; Ru-5Rh; Ru-2Rh; Ru-1Rh;

Ru-45Ir; Ru-40Ir; Ru-35Ir; Ru-30Ir; Ru-25Ir; Ru-20Ir; Ru-15Ir; Ru-10Ir; Ru-5Ir; Ru-2Ir; Ru-1Ir; Ru-45Pt; Ru-40Pt; Ru-35Pt; Ru-30Pt; Ru-25Pt; Ru-20Pt; Ru-15Pt; Ru-10Pt; Ru-5Pt; Ru-2Pt; Ru-1Pt; Ru-35Rh-20Ir; Ru-35Rh-20Pt; Ru-35Ir-20Rh; Ru-35Ir-20Pt; Ru-35Pt-20Rh; Ru-35Pt-20Ir; Ru-25Rh-20Ir; Ru-25Rh-20Pt; Ru-25Ir-20Rh; Ru-25Ir-20Pt; Ru-25Pt-20Rh; Ru-25Pt-20Ir; Ru-20Rh-20Ir; Ru-20Rh-20Pt; Ru-20Ir-20Pt; Ru-15Rh-15Ir; Ru-15Rh-15Pt; Ru-15Ir-15Pt; Ru-10Rh-10Ir; Ru-10Rh-10Pt; Ru-10Ir-10Pt; Ru-(1-20)Rh-(1-20)Ir; Ru-(1-10)Rh-(1-10)Ir; Ru-(1-8)Rh-(1-8)Ir; Ru-(1-5)Rh-(1-5)Ir; Ru-(1-5)Rh-(1-2)Ir; Ru-(1-20)Rh-(1-20)Pt; Ru-(1-20)Rh-(1-20)Pd; Ru-(1-20)Rh-(1-20)Au; Ru-(1-20)Ir-(1-20)Pt; Ru-(1-20)Ir-(1-20)Pd; Ru-(1-20)Ir-(1-20)Au; Ru-(1-20)Pt-(1-20)Pd; Ru-(1-20)Pt-(1-20)Au; and Ru-(1-20)Pd-(1-20)Au.

The ruthenium-based material preferably includes rhenium (Re), tungsten (W), or both rhenium (Re) and tungsten (W). Rhenium (Re) and tungsten (W) have rather high melting points; thus, their addition to the ruthenium-based material can increase the overall melting temperature of the material. The melting point of rhenium (Re) is approximately 3180° C. and that of tungsten (W) is around 3410° C. As those skilled in the art will appreciate, ruthenium-based materials having high melting temperatures are generally more resistant to electrical erosion in spark plugs, igniters and other applications that are exposed to similar high-temperature environments.

The inclusion of rhenium (Re) and tungsten (W) may also supplement the effects of the "fibrous" grain structure and provide the ruthenium-based material with certain desirable attributes—such as increased ductility, higher spark erosion resistance due to higher melting temperatures, and greater control of grain growth because of increased recrystallization temperatures. More specifically, it is possible for the rhenium (Re) and/or tungsten (W) to improve the ductility of the ruthenium-based material by increasing the solubility or dissolvability of some interstitial components (N, C, O, S, P, etc.) with respect to the ruthenium (Ru) phase matrix. Affecting the solubility of the interstitials in this way can help keep the interstitials from congregating at the grain boundaries which, in turn, can render the ruthenium-based material more ductile and workable, particularly during high-temperature processes, and less susceptible to erosion through grain cleavage at high-temperatures. Although ruthenium-based materials could be produced that only include rhenium (Re) or tungsten (W) but not both, the co-addition of Re and W has shown a synergistic effect that improves ductility and formability.

The high melting points of the added rhenium (Re) and tungsten (W) can increase the recyrstallization temperature of the ruthenium-based material by 50° C.-100° C. and, thus, rhenium (Re) and/or tungsten (W) may also be useful in controlling grain growth during certain high-temperature processes like sintering, annealing, hot swaging, hot extruding, hot drawing, and even during use or application at high temperatures. The recyrstallization temperature of the material, when at least one of rhenium (Re) or tungsten (W) is added, may be found to be above 1400° C.; thus, hot forming processes below this temperature would not introduce abnormal grain growth. The ability to hot-form the ruthenium-based material as needed—for example, into a wire from which any of the firing tips shown in FIGS. 1-5 can be derived—without experiencing abnormal grain growth is helpful for at least two reasons. First, the "fibrous" grain structure described below can be more easily maintained. And second, cracking and failure of the electrode material can be mitigated. The term "grain growth," as used herein, refers to growth in the size of the grain (i.e., the volume of the grain) during some type of high-temperature process. For example, during a hot-drawing process of the ruthenium-based material with appropriate amounts of rhenium (Re) and tungsten (W), the grains may become more elongated so that some of the dimensions of the grains increase, yet the overall average size of the grains may be controlled so that they remain relatively constant.

According to one embodiment, the ruthenium-based material includes ruthenium (Ru) from about 50 wt % to 99 wt %, rhenium (Re) from about 0.1 wt % to 10 wt %, and/or tungsten (W) from about 0.1 wt % to 10 wt %. Some non-limiting examples of potential compositions for such alloys include (in the following compositions, the Ru constitutes the balance): Ru-10Re; Ru-5Re; Ru-2Re; Ru-1Re; Ru-0.5Re; Ru-0.1Re; Ru-10W; Ru-5W; Ru-2W; Ru-1W; Ru-0.5W; Ru-0.1W; Ru-10Re-10W, Ru-5Re-5W, Ru-2Re-2W, Ru-1Re-1W, Ru-0.5Re-0.5W and Ru-0.1Re-0.1W. An exemplary ternary alloy composition that may be particularly useful for spark plug applications is Ru-(0.5-5)Re-0.5-5)W, such as Ru-1Re-1W, but of course others are certainly possible. In a number of the exemplary ruthenium-based materials just mentioned, as well as those described below, the preferred ratio of rhenium to tungsten is 1:1. But this ratio is not required. Other ratios may indeed be used as well.

According to another embodiment, the ruthenium-based material includes ruthenium (Ru) from about 50 wt % to 99 wt %, at least one of rhenium (Re) from about 0.1 wt % to 10 wt % or tungsten (W) from about 0.1 wt % to 10 wt %, and a precious metal—other than the Ru just mentioned—from about 1 wt % to 40 wt %. Some examples of suitable electrode materials having only one precious metal added to the ruthenium-based material include: Ru—Rh—Re, Ru—Rh—W, Ru—Ir—Re, Ru—Ir—W, Ru—Pt—Re, Ru—Pt—W, Ru—Rh—Re—W, Ru—Ir—Re—W, Ru—Pt—Re—W, Ru—Pd—Re—W and Ru—Au—Re—W alloys, where the ruthenium (Ru) is still the largest single constituent. Some non-limiting examples of potential compositions for such alloys include (in the following compositions, the Re and W contents are between about 0.1 wt % and 10 wt % and the Ru constitutes the balance): Ru-(1-40)Rh—Re, Ru-(1-30)Rh—Re; Ru-(1-20)Rh—Re; Ru-(1-15)Rh—Re; Ru-(1-10)Rh—Re; Ru-(1-8)Rh—Re; Ru-(1-5)Rh—Re; Ru-(1-2)Rh—Re; Ru-(1-40)Rh—W, Ru-(1-30)Rh—W; Ru-(1-20)Rh—W; Ru-(1-15)Rh—W; Ru-(1-10)Rh—W; Ru-(1-8)Rh—W; Ru-(1-5)Rh—W; Ru-(1-2)-Rh—W; Ru-40Rh—Re—W, Ru-30Rh—Re—W, Ru-20Rh—Re—W, Ru-15Rh—Re—W, Ru-10Rh—Re—W, Ru-8Rh—Re—W; Ru-5Rh—Re—W, Ru-2Rh—Re—W, Ru-1Rh—Re—W, Ru-40Ir—Re—W, Ru-30Ir—Re—W, Ru-20Ir—Re—W, Ru-15Ir—Re—W, Ru-10Ir—Re—W, Ru-5Ir—Re—W, Ru-2Ir—Re—W, Ru-1Ir—Re—W, Ru-40Pt—Re—W, Ru-30Pt—Re—W, Ru-20Pt—Re—W, Ru-15Pt—Re—W, Ru-10Pt—Re—W, Ru-5Pt—Re—W, Ru-2Pt—Re—W, Ru-1Pt—Re—W, Ru-40Pd—Re—W, Ru-30Pd—Re—W, Ru-20Pd—Re—W, Ru-15Pd—Re—W, Ru-10Pd—Re—W, Ru-5Pd—Re—W, Ru-2Pd—Re—W, Ru-1Pd—Re—W, Ru-40Au—Re—W, Ru-30Au—Re—W, Ru-20Au—Re—W, Ru-15Au—Re—W, Ru-10Au—Re—W, Ru-5Au—Re—W, Ru-2Au—Re—W and Ru-1Au—Re—W. An exemplary quaternary alloy composition that may be particularly useful for spark plug applications is Ru-(1-10)Rh-(0.5-5)Re-0.5-5)W and more particularly Ru-(1-8)Rh-(0.5-2)Re-0.5-2)W. A specific example of such an alloy is Ru-5Rh-1Re-1W, where the amount of the precious metal is greater than at least one of the rhenium (Re) or the tungsten (W).

According to another embodiment, the ruthenium-based material includes ruthenium (Ru) from about 50 wt % to 99 wt %, rhenium (Re) from about 0.05 wt % to 10 wt %, tungsten (W) from about 0.05 wt % to 10 wt %, a first precious metal from about 1 wt % to 40 wt %, and a second precious metal from about 1 wt % to 40 wt %, where the first and second precious metals are different than ruthenium (Ru). Some examples of suitable ruthenium-based materials having two additional precious metals include: Ru—Rh—Pt—Re—W, Ru—Rh—Ir—Re—W, Ru—Rh—Pd—Re—W, Ru—Rh—Au—Re—W, Ru—Pt—Ir—Re—W, Ru—Pt—Pd—Re—W, Ru—Pt—Au—Re—W, Ru—Ir—Pd—Re—W, Ru—Ir—Au—Re—W and Ru—Au—Pd—Re—W alloys, where the ruthenium (Ru) is still the largest single constituent in the respective alloys. Some non-limiting examples of potential compositions for such alloys include (in the following compositions, the Re and W content is between about 0.1 wt % and 10 wt % and the Ru constitutes the balance): Ru-30Rh-30Pt—Re—W, Ru-20Rh-20Pt—Re—W, Ru-10 Rh-10 Pt—Re—W, Ru-5 Rh-5 Pt—Re—W, Ru-2Rh-2Pt—Re—W, Ru-30Rh-30Ir—Re—W, Ru-20Rh-20Ir—Re—W, Ru-10Rh-10Ir—Re—W, Ru-5Rh-5Ir—Re—W and Ru-2Rh-2Ir—Re—W, to cite a few possibilities. It is also possible for the ruthenium-based material to include three or more precious metals, such as Ru—Rh—Pt—Ir—Re—W, Ru—Rh—Pt—Pd or Ru—Rh—Pt—Au—Re—W. An exemplary composition that may be particularly useful for spark plug applications is Ru-(1-10)Rh-(1-10)Pt-(0.05-5)Re-0.05-5)W and more particularly Ru-(1-8)Rh-(1-10)Ir-(0.05-2)Re-0.05-2)W. A few specific examples of such alloys are Ru-5Rh-5Pt-1Re-1W, Ru-5Rh-1Ir-1Re, and Ru-5Rh-1Ir-1W, but other alloy compositions are possible as well.

Depending on the particular properties that are desired, the amount of ruthenium (Ru) in the ruthenium-based material may be: greater than or equal to 50 wt %, 65 wt % or 80 wt %; less than or equal to 99%, 95 wt %, 90 wt % or 85 wt %; or between 50-99%, 65-99 wt % or 80-99 wt %, to cite a few examples. Likewise, the individual amounts of the rhenium (Re) and the tungsten (W) in the ruthenium-based material may be: greater than or equal to 0.1 wt % or 1 wt %; less than or equal to 10 wt %, 5 wt % or 2 wt %; or between 0.1-10 wt %, 0.5-5 wt %, or 0.5-2 wt %. The amount of rhenium (Re) and tungsten (W) together in the ruthenium-based material may be: greater than or equal to 0.5 wt %, 1 wt %, 1.5 wt % or 2 wt %; less than or equal to 20 wt %, 10 wt % or 2 wt %; or between 0.2-20 wt %, 1-10 wt % or 1-3 wt %. The preceding amounts, percentages, limits, ranges, etc. are only provided as examples of some of the different material compositions that are possible, and are not meant to limit the scope of the ruthenium-based material.

One or more rare earth metals may be added to the various ruthenium-based materials described above, like yttrium (Y), hafnium (Hf), scandium (Sc), zirconium (Zr), lanthanum (La) or cerium (Ce). Those skilled in the art will appreciate that such metals can not only trap some impurities, but also form rhenium-rich fine precipitates. Reducing the impurities in the matrix of the ruthenium-based material may increase the ductility of the material. The fine precipitates can play a role in pinning the grain boundaries and preventing or controlling grain growth during certain processes and applications. The content of these rare earth metals in the ruthenium-based material preferably ranges from about several ppm to about 0.3 wt %.

Figure 6:
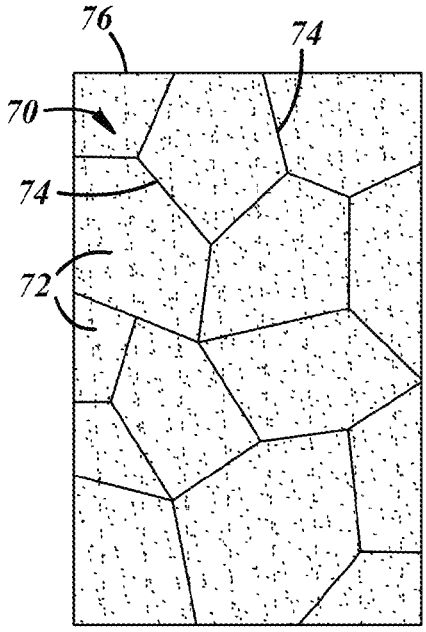
FIG. 6 is a schematic illustration of an electrode material having a grain structure other than the "fibrous" grain structure described below.
Figure 7:
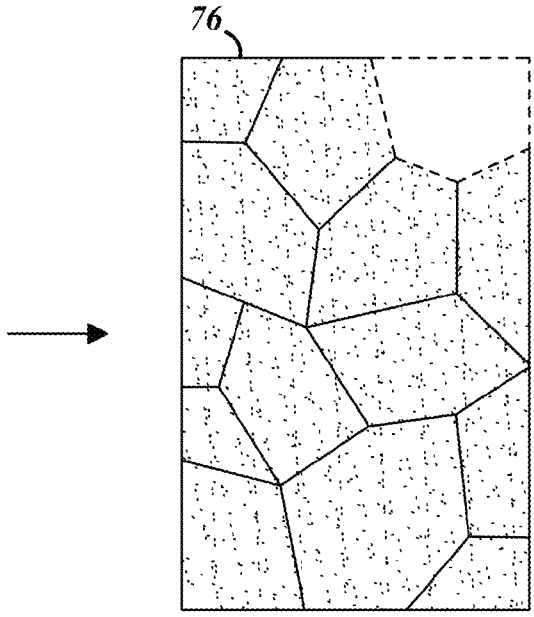
FIG. 7 is a schematic representation illustrating an erosion mechanism for the electrode material of FIG. 6 in which a grain is cleaved and lost at a surface of the electrode material.

Ruthenium-based materials in general possess favorable oxidation, corrosion, and erosion resistance that is desirable in certain applications including in internal combustion engines, as just explained. But they also have a tendency to exhibit less-than-desirable room-temperature ductility—which affects how easily such materials can be fabricated into a useable piece—and may experience high-temperature durability issues such as material erosion due to brittleness and/or impurity concentration at surface-adjacent grain boundaries. For example, as shown illustratively in FIG. 6, a ruthenium-based material with a grain structure 70 that includes equiaxed grains 72 can be susceptible to crack propagation in all directions along grain boundaries 74. Interstitial components—like nitrogen (N), carbon (C), oxygen (O), sulfur (S), phosphorous (P), etc.—that may accumulate at the grain boundaries 74 can also segregate the grains 72 and provoke grain cleavage, as depicted at the upper right-hand corner in FIG. 7, when the grain boundaries 74 near an exposed exterior surface 76 of the material are heated and/or subjected to stress. This susceptibility to multi-directional crack propagation and surface grain cleavage is thought to be at least partially responsible for the ductility and durability concerns surrounding the use of a ruthenium-based material as an electrode material.

Figure 10:
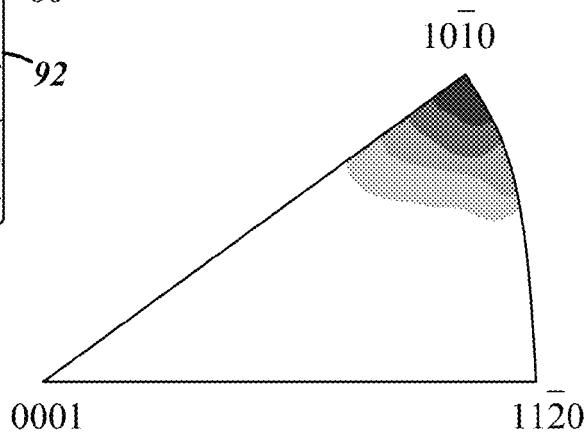
FIG. 10 is a plot showing an extrusion-axis inverse pole figure for a ruthenium-based electrode material having the "fibrous" grain structure illustrated in FIG. 8.

The "fibrous" grain structure (or elongated grain structure) of the ruthenium-based material can help mitigate these issues. An example of the "fibrous" grain structure is shown generally and schematically in FIG. 8 and is identified by reference numeral 80. The "fibrous" grain structure comprises elongated grains 82 defined by grain boundaries 84. Each of these grains 82 has an axial dimension 82A and a radial dimension 82R. The axial dimension 82A of the grains 82 is generally greater than the radial dimension 82R by a multiple of two or more, and, typically, six or more (e.g., 82A≥6×82R). The grains 82 are also oriented generally parallel to one another; that is, the axial dimensions 82A of the grains 82 are generally—but not necessarily exactly—aligned in parallel. Strict parallelism is not required for the grains 82 to be considered generally parallel since it may be difficult, or impractical, to form all of the grains 82 with consistent sizes in both the axial 82A and radial 82R dimensions, perfectly alligned end-to-end abutments, and perfectly smooth side-by-side interfaces, among others. Some leeway is tolerated so long as the grains 82 as a group have their axial dimensions 82A extending in the same general direction. The terms "axial dimension" and "radial dimension" are used here to broadly denote the major dimensions of the grain 82; they are not intended to suggest that the grains 82 are necessarily restricted to being cylindrical in shape. Moreover, as shown in FIG. 10, the elongated grains 82 may also have a crystal orientation (sometimes referred to as a "texture") in which the dominant grains have their [0001] hexagonal axis of crystals generally perpendicular to axial dimensions 82A of the grains 82. Such a crystal orientation can help improve the ductility of the electrode material in the direction parallel to the axial dimensions 82A of the elongated grains 82, which may be noteworthy for ruthenium-based materials that have a hexagonal close packed (hcp) crystal structure and relatively poor ductility in nature.

Figure 8:
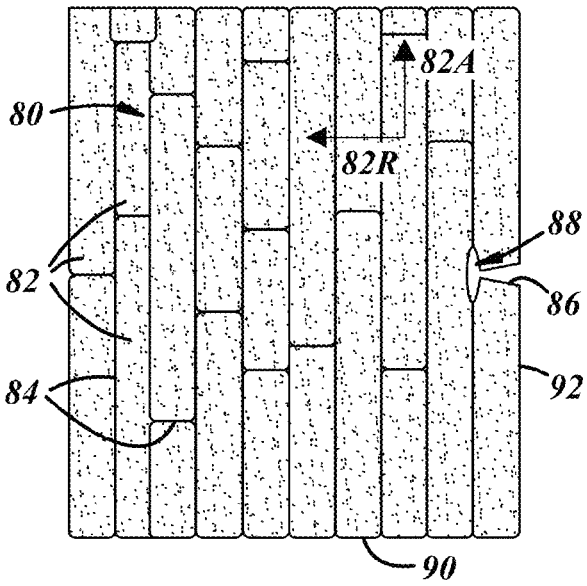
FIG. 8 is a generalized illustration of an electrode material that has a "fibrous" grain structure which includes elongated grains.

The "fibrous" grain structure 80 is expected to improve the room-temperature ductility and high-temperature durability of the ruthenium-based material compared to other grain structures. The improved ductility makes the ruthenium-based material more workable and, thus, easier to fabricate into a useful part, while the improved durability helps mitigate erosion when the material is exposed to high-temperature environments for an extended period of time. The "fibrous" grain structure 80 is believed to improve ductility and reduce inter-granular grain loss by inhibiting crack propagation through the ruthenium-based material transverse to the axial dimensions 82A of the grains 82. This so called "crack blunting" phenomenon is illustrated in FIG. 8. There, it can be seen that a surface-initiated crack 86 can propagate only a small distance into the material before being blunted at a contiguous interfacial region 88 of neighboring interior grain 82. Such extensive crack blunting capabilities are not attainable by other grain structures, like the one illustrated in FIGS. 6-7, in which the grains are less elongated and more equiaxed. The "fibrous" grain structure 80 is thought to improve high-temperature durability because it is less susceptible to crack propagation—for the reasons just discussed. These structural characteristics make it more difficult to segregate and cleave the grains 82 from the ruthenium-based material in the manner illustrated in FIGS. 6-7. The inclusion of certain constituents into the ruthenium-based material, as described above, may further promote ductility and high-temperature durability gains in addition to those attributed to the "fibrous" grain structure 80.

The ruthenium-based material is preferably employed in an ignition device—such as any of the spark plugs shown in FIGS. 1-5—so that a surface 90 of the material normal to the axial dimensions 82A of the grains 82 (hereafter "normal surface 90" for brevity) constitutes the sparking surface. Such an orientation of the ruthenium-based material within the spark plug 10 may result in the axial dimensions 82A of the grains 82 lying parallel to a longitudinal axis $L_C$ of the center electrode 12 (FIG. 2) if the material is attached to the center electrode 12 or the ground electrode 18. For example, if the ruthenium-based material is used as the firing tip 32 for the multi-layer rivet (MLR) design shown in FIGS. 1-2, the normal surface 90 preferably faces the firing tip 30 attached to the ground electrode 18. In doing so, the axial dimensions 82A of the grains 80 lie parallel to the longitudinal axis $L_C$ of the center electrode 12 and perpendicular to the sparking surface of the firing tip 32. The ruthenium-based material is also preferably used in the same way for the other firing tip components 40, 50, shown in FIGS. 3-4. Likewise, as another example, if the ruthenium-based material is used as a firing tip 30, 42 attached to the ground electrode 18 in the designs shown in FIGS. 1-3, the normal surface 90 preferably faces the firing tip 32, 40 attached to the center electrode 12. In these embodiments, the axial dimensions 82A of the grains 80 lie parallel to the longitudinal axis $L_C$ of the center electrode 12, as before, and perpendicular to the sparking surface of the firing tip 32. Using another surface of the ruthenium-based material—besides the normal surface 90—as the sparking surface, although not as preferred, may still be practiced. For example, if the ruthenium-based material is used as the firing tip 60 for the design shown in FIG. 5, the normal surface 90 of the material may not face the firing tip 62 attached to the ground electrode 18; instead, a side surface 92 may face the firing tip 62 and act as the sparking surface.

Figure 9:
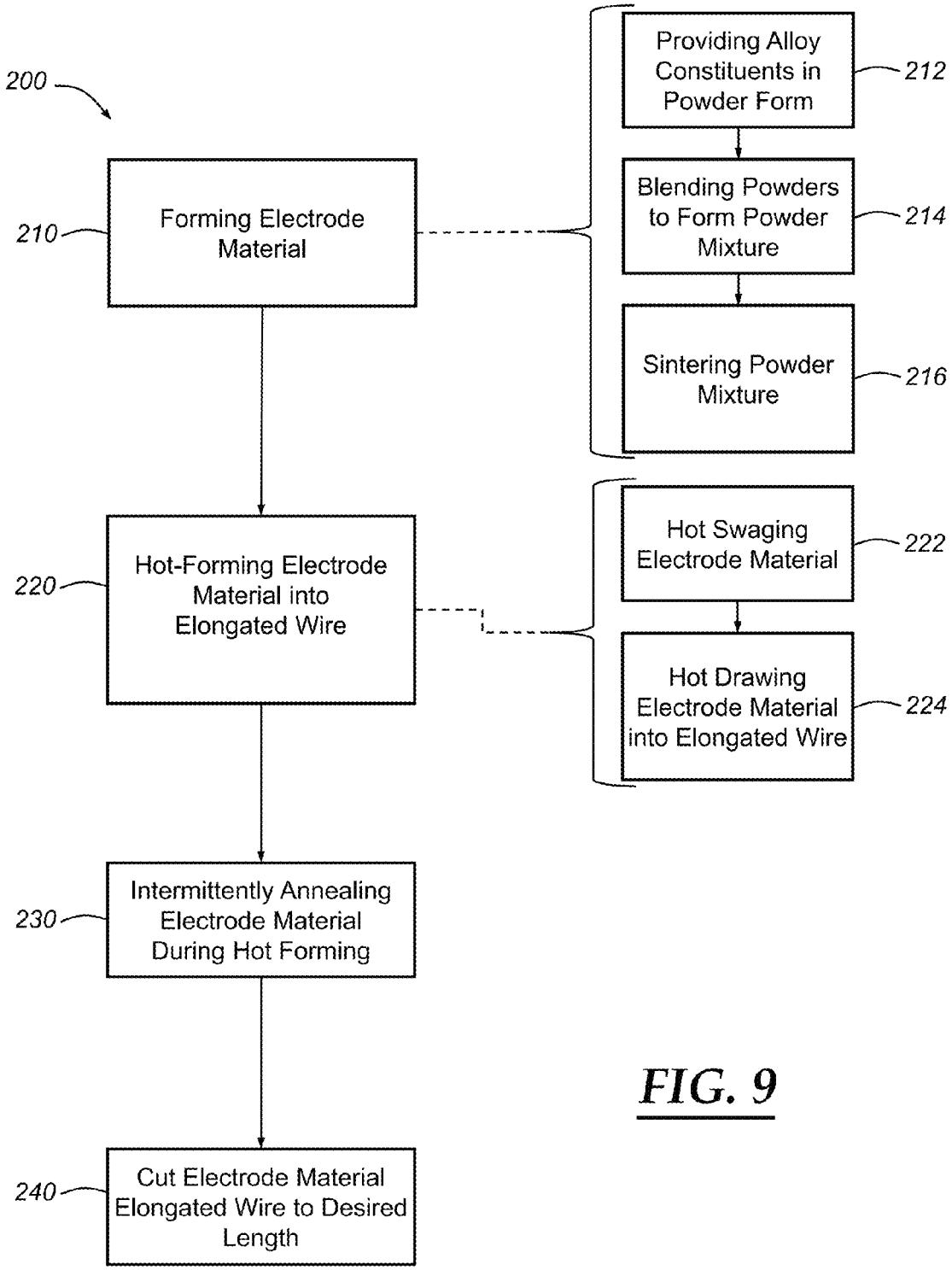
FIG. 9 is a flowchart illustrating an exemplary method for forming a ruthenium-based electrode material that has the "fibrous" grain structure illustrated in FIG. 8.

Turning now to FIG. 9, the electrode material can be made and formed into an appropriate shape using a variety of manufacturing processes. For instance, a process 200 may be used that includes the steps of: forming a bar of the ruthenium-based material that has a length and a first diameter, step 210; hot-forming the ruthenium-based material bar into an elongated wire having a second diameter smaller than the first diameter and the "fibrous" grain structure 80, step 220; and intermittently annealing the ruthenium-based material during hot-forming to maintain the "fibrous" grain structure 80 as the ruthenium-based material undergoes diameter reduction from the first diameter of the bar to the second diameter of the elongated wire, step 230. The forming step 210 is preferably carried out by a powder metallurgy process, as will be described below. The hot-forming step 220 preferably includes hot-swaging and hot-drawing the ruthenium-based material. But like the forming process 210, skilled artisans will appreciate that other processes may be performed in addition to, or in lieu of, hot-swaging and hot-drawing, such as hot-extrusion, and still achieve the same objectives. The process 200 may further include one or more optional steps that provide a cladding or sheath around the ruthenium-based material, if desired.

In the preferred embodiment of step 210, a powder metallurgy process may involve providing the alloy constituents in powder form, step 212; blending the powders together to form a powder mixture, step 214; and sintering the powder mixture to form a bar of the ruthenium-based material that has a length and the first diameter, step 216. The different constituents of the ruthenium-based material may be provided in powder form (step 212) where they each have a certain powder or particle size in any known manner. According to one exemplary embodiment, ruthenium (Ru), one or more precious metals (e.g., rhodium (Rh), platinum (Pt), etc.), rhenium (Re), and tungsten (W) are individually provided in a powder form where each of the constituents has a particle size of about 0.1 μm to 100 μm, inclusive. In another embodiment, the ruthenium (Ru) and one or more of the constituents are pre-alloyed and formed into a base alloy powder first, before being mixed with the other powder constituents. The non-pre-alloying embodiment may be applicable to more simple systems (e.g., Ru—Re—W), while the pre-alloying embodiment is better suited for more complex systems (e.g., Ru—Rh—Re—W, Ru—Rh—Pt—Re—W and Ru—Rh—Ir—Re—W). Pre-alloying the ruthenium and other alloy constituents—exclusive of rhenium and tungsten—into a base alloy powder, and then mixing the base alloy powder with rhenium and tungsten, may also promote enrichment of the grain boundaries 84 with the later-mixed transition metal element(s).

Next, in step 212, the powders may be blended together so that a powder mixture is formed. In one embodiment, the powder mixture includes from about 50 wt % to 99 wt % of ruthenium (Ru), from about 1 wt % to 40 wt % of rhodium (Rh), from about 0.1 wt % to 10 wt % of rhenium (Re), and from about 0.1 wt % to 10 wt % of tungsten (W), regardless of whether a pre-alloyed base alloy powder was formed or not. This mixing step may be performed with or without the addition of heat.

The sintering step 216 transforms the powder mixture into the bar of the ruthenium-based material through the application of heat. The resultant bar has a length and a first diameter, as previously mentioned, with the length representing a longitudinal dimension of the bar and the first diameter representing a cross-sectional dimension transverse to, and less than, the length, as is generally understood by skilled artisans. The sintering step 216 may be performed according to a number of different metallurgical embodiments. For instance, the powder mixture may be sintered in a vacuum, in a reduction atmosphere such as in a hydrogen-contained environment, or in some type of protected environment for up to several hours at an appropriate sintering temperature. Oftentimes an appropriate sintering temperature lies somewhere in the range of about 1350° C. to about 1650° C. for the ruthenium-based powder mixture. It is also possible for sintering step 216 to apply pressure in order to introduce some type of porosity control to the ruthenium-based material. The amount of pressure applied may depend on the precise composition of the powder mixture and the desired attributes of the ruthenium-based material. The sintering step 216 is preferably practiced in a way that results in a cylindrical bar. A cylindrical bar of the ruthenium-based material in which the first diameter ranges from about 10 mm to about 30 mm, for instance about 20 mm, and a length of the bar ranges from about 2.0 m to about 0.5 m, for instance about 1 m, is generally acceptable. Such preferred geometrical measurements are by no means exclusive, however.

Next, the bar of the ruthenium-based material is hot-formed into an elongated wire having a second diameter smaller than the first diameter and the "fibrous" grain structure 80. The second diameter of the ruthenium-based material wire may be at least 60%, at least 80%, or at least 95% less than the first diameter. The hot-forming step 220 preferably includes a hot-swaging 222 step followed by a hot-drawing 224 step. Hot-swaging may involve radially hammering or forging the ruthenium-based material bar at a temperature above the ductile-brittle transition temperature to reduce the diameter of the material and, consequently, effectuate work-hardening. A typical temperature for conducting hot-swaging usually lies in the range of about 900° C. to about 1400° C. for the ruthenium-based material. The hot-swaging step 22 may reduce the diameter of the ruthenium-based material bar from the first diameter by up to about 50%. For example, the preferred cylindrical bar formed by the powder metallurgy process may, following a 50% reduction in diameter by hot-swaging, have a diameter that ranges from about 5 mm to about 15 mm, for instance about 10 mm, and a length that ranges about 16m to about 1.8m, for instance about 4m. The ruthenium-based material bar does not yet have the "fibrous" grain structure 80 on account of the hot-swaging process 222.

The hot-drawing step 224 may include drawing the ruthenium-based material bar—or a portion of the bar—through an opening defined in a heated draw plate to transform the hot-swaged cylindrical bar into an elongated wire of the desired size. The draw plate opening is appropriately sized to reduce the diameter of the ruthenium-based material bar. The temperature of the draw plate may be maintained at a temperature that heats the ruthenium-based material above its ductile-brittle transition temperature. A typical temperature of the ruthenium-based material for conducting hot-drawing may lie anywhere in the range from about 900° C. to about 1300° C. for the ruthenium-based material. Hot-drawing may further reduce the diameter of the ruthenium-based material bar from that achieved by hot-swaging by at least 85%, for instance, in the range of about 90% to about 98%, in order to achieve the second diameter of the ruthenium-based material depending on the desired end-configuration. For example, the preferred cylindrical bar electrode material formed by the powder metallurgy process and hot-swaged to a 50% diameter reduction may, following a 93% reduction in diameter by hot-drawing, have a diameter that ranges from about 0.35 mm to about 1.05 mm, for instance about 0.7, and a length that ranges about 3265 m to about 363 m, for instance about 816 m, assuming the entire ruthenium-based material bar is formed into a single elongated wire. To achieve the desired diameter reduction during hot-drawing, the ruthenium-based material bar may have to be drawn through several successively smaller die plate openings, as attempts to reduce the diameter of the ruthenium-based material bar by too much in a single pass may cause undesirable structural damage. Each pass through a die plate opening may achieve about a 10% to about a 30% reduction in diameter under such circumstances.

The hot-drawing step 224 generates the "fibrous" grain structure 80 along an elongation axis of the ruthenium-based material as the material is pulled through the heated die plate opening(s). It also generates the crystal orientation in which the dominant grains have their [0001] hexagonal axis of crystals perpendicular to the elongation axis of the wire and, thus, the axial dimensions 82A of the elongated grains 82. The extensive diameter reductions sought to be achieved during hot-drawing, however, typically require intermittent annealing to relieve stresses imparted to the ruthenium-based material. But such annealing, which generally involves heating the ruthenium-based material for at least a few minutes, has a tendency to facilitate grain growth and, ultimately, removal of the "fibrous" grain structure 80 if extensive recrystallization is allowed to occur.

For this reason, the ruthenium-based material is intermittently annealed (step 230) during hot-forming—in particular during hot-drawing—in a manner that maintains the "fibrous" grain structure 80 as the first diameter of the ruthenium-based material bar is decreased to the second diameter of the ruthenium-based material wire. This may involve annealing the ruthenium-based material at a temperature below its recrystallization temperature at least after every 50% reduction in diameter. Of course annealing may be performed after smaller diameter reductions such as, for example, after every 35% reduction or even after every 20% reduction in diameter, if desired. In other words, the ruthenium-based material may be hot-drawn, then annealed to relieve internal stress, then hot-drawn again, then annealed again, and so on, with annealing being performed at least once for every 50% reduction in diameter of the ruthenium-based material during transformation of the bar fabricated by hot-swaging into the elongated wire. An annealing temperature between about 1000° C. to about 1500° C. is generally sufficient to prevent loss of the "fibrous" grain structure 80. The inclusion of the element(s) that increase the recrystallization temperature of the ruthenium-based material (Re and W, for example) also makes preserving the "fibrous" grain structure 80 that much easier despite the fact that the ruthenium-based material bar/wire may have to be subjected to several intermittent annealing steps 230. Any annealing that may be required after the hot-swaging step 222, but before the hot-drawing step 224, may be performed with less attention paid to the effects of recrystallization since the "fibrous" grain structure 80 sought to be preserved is likely not present at this time.

Following the hot-drawing step 224, the elongated ruthenium-based material wire preferably has a diameter between about 0.3 mm to about 1.5 mm. The ruthenium-based material wire may be cut into individual pieces of a desired length by shearing or a diamond saw, shown as step 240 in FIG. 9, which may then be used as firing tip components attached to a center electrode, a ground electrode, an intermediate component, etc. In one example, the individually sliced pieces may be used as firing tip component 32 that is attached to the intermediate component 34, as shown in FIGS. 1-2. The process 200 described above may also be used to form the ruthenium-based material into various shapes that are suitable for further spark plug electrode and/or firing tip manufacturing processes. Other known techniques such as melting and blending the desired amounts of each constituent may be used in addition to or in lieu of those steps mentioned above. The ruthenium-based material can be further processed using conventional cutting and grinding techniques that are sometimes difficult to use with other known erosion-resistant electrode materials.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A method of making an electrode material, the method comprising the steps of:

(a) forming a ruthenium-based material into a bar that has a length and a first diameter, the ruthenium-based material having ruthenium (Ru) as the single largest constituent on a weight percentage (wt %) basis;

(b) hot-forming the bar of the ruthenium-based material into an elongated wire that has a second diameter and a fibrous grain structure, the second diameter being smaller than the first diameter; and (c) intermittently annealing the ruthenium-based material during step (b) to maintain the fibrous grain structure as the ruthenium-based material undergoes diameter reduction from the first diameter of the bar to the second diameter of the elongated wire.

2. The method of claim 1, wherein step (b) comprises:

hot-drawing the bar of the ruthenium-based material through a heated draw plate at least once to form the elongated wire, and wherein the second diameter of the elongated wire is at least 80% less than the first diameter of the bar.

3. The method of claim 2, wherein the intermittent annealing step is performed at least once for every 50% reduction in diameter by hot-drawing.

4. The method of claim 2, further comprising:

hot-swaging the bar of the ruthenium-based material before hot-drawing.

5. The method of claim 1, wherein the intermittent annealing is performed below the recrystallization temperature of the ruthenium-based material.

6. The method of claim 1, wherein the ruthenium-based material further comprises at least one of rhodium, iridium, platinum, palladium, gold, or a combination thereof.

7. The method of claim 1, wherein the ruthenium-based material further comprises at least one of tungsten, rhenium, or a combination of tungsten and rhenium.

8. The method of claim 1, wherein the ruthenium-based material is selected from the group consisting of Ru-(0.5-5)Re-0.5-5)W, Ru-(1-10)Rh-(0.5-5)Re-0.5-5)W, and Ru-(1-10)Rh-(1-10)Pt-(0.05-5)Re-0.05-5)W, wherein the numerical ranges are provided in wt. %.

9. The method of claim 1, further comprising:

cutting a segment of the ruthenium-based material from the elongated wire, the segment having a diameter between about 0.3 mm and about 1.5 mm; and attaching the segment of the ruthenium-based electrode material to a center electrode of a spark plug by way of an intermediate firing tip component.

10. The method of claim 9, wherein the fibrous grain structure of the segment of the ruthenium-based material includes elongated grains that have axial dimensions aligned generally parallel to a longitudinal axis of the center electrode.

11. A method of making an electrode material, the method comprising the steps of:

(a) providing a ruthenium-based material that comprises ruthenium (Ru) as the single largest constituent on a weight percentage (wt %) basis;

(b) hot-drawing the ruthenium-based material through an opening defined in a heated draw plate along an elongation axis to provide the ruthenium-based material with elongated grains generally parallel to the elongation axis;

(c) annealing the ruthenium-based material at a temperature that maintains the elongated grains; and (d) repeating steps (b) and (c) to form an elongated wire of the ruthenium-based material.

12. The method of claim 11, wherein the ruthenium-based material further comprises another precious metal in addition to ruthenium, and further comprises at least one of tungsten, rhenium, or a combination of tungsten and rhenium.

13. The method of claim 11, further comprising:

hot-swaging the ruthenium-based material, before hot-drawing, at a temperature above the ductile-brittle temperature of the ruthenium-based material.

14. The method of claim 13, wherein the hot-swaging reduces a diameter of the ruthenium-based material by up to 50%.

15. The method of claim 14, wherein step (d) is carried out to reduce the diameter of the ruthenium-based material by at least an additional 85% following hot-swaging, and wherein the annealing is performed at least once for every 50% reduction in the diameter of the ruthenium-based material during hot-drawing.

16. The method of claim 11, further comprising:

cutting a segment of the ruthenium-based material from the elongated wire, the segment including elongated grains that have axial dimensions; and attaching the segment of the ruthenium-based electrode material to a center electrode or a ground electrode such that a surface of the segment normal to the axial dimensions of the elongated grains constitutes a sparking surface.

17. The method of claim 16, wherein the segment of the ruthenium-based material is attached to the center electrode by way of an intermediate firing tip component.

18. A spark plug comprising:

a metallic shell having an axial bore;

an insulator being at least partially disposed within the axial bore of the metallic shell, the insulator having an axial bore;

a center electrode being at least partially disposed within the axial bore of the insulator; and a ground electrode being attached to the metallic shell;

wherein the center electrode, the ground electrode, or both the center and ground electrodes includes a electrode material that has a fibrous grain structure, and wherein the electrode material is a ruthenium-based material having ruthenium (Ru) as the single largest constituent on a weight percentage (wt %) basis.

19. The spark plug of claim 18, wherein the ruthenium-based material is in the form of a firing tip component that is attached to the center electrode by way of an intermediate firing tip component.

20. The spark plug of claim 19, wherein the firing tip component includes elongated grains that have axial dimensions aligned generally parallel to a longitudinal axis of the center electrode.

* * * * *